United States Patent [19]

McCullough

[11] 3,986,799

[45] Oct. 19, 1976

[54] FLUID-COOLED, SCROLL-TYPE, POSITIVE FLUID DISPLACEMENT APPARATUS

[75] Inventor: John E. McCullough, Carlisle, Mass.

[73] Assignee: Arthur D. Little, Inc., Cambridge, Mass.

[22] Filed: Nov. 3, 1975

[21] Appl. No.: 627,854

[52] U.S. Cl. ..... 418/55; 418/56; 418/57; 418/85; 418/88; 418/91; 418/151; 418/178

[51] Int. Cl.[2] ..... F01C 1/02; F01C 19/08; F01C 21/00; F01C 21/06

[58] Field of Search ..... 418/55, 56, 57, 85, 418/88, 91, 94, 131, 151, 178

[56] References Cited

UNITED STATES PATENTS

| | | | |
|---|---|---|---|
| 2,849,988 | 9/1958 | Nilsson | 418/94 |
| 2,938,664 | 5/1960 | Noller | 418/85 |
| 3,600,114 | 8/1971 | Dvorak et al. | 418/55 |
| 3,802,809 | 4/1974 | Vulliez | 418/55 |
| 3,884,599 | 5/1975 | Young et al. | 418/55 |

*Primary Examiner*—John J. Vrablik
*Attorney, Agent, or Firm*—Bessie A. Lepper

[57] ABSTRACT

Cooling means are provided for the stationary and orbiting scroll members of scroll-type apparatus. These cooling means comprise fluid coolant channels in the end plates and in the involute wraps of the scroll members and means to circulate a fluid coolant therethrough. In the case of the stationary scroll member the coolant may be water, oil or the like; while in the case of the orbiting scroll member the coolant is the lubricating oil used to lubricate a thrust bearing and the coupling means. The resulting effective cooling of the scroll members makes it possible to form scroll apparatus in large sizes.

21 Claims, 11 Drawing Figures

FLUID-COOLED, SCROLL-TYPE, POSITIVE FLUID DISPLACEMENT APPARATUS

The invention herein described was made in the course of or under a contract or subcontract thereuncer, with the Department of the Navy.

This invention relates to scroll-type apparatus and more particularly to scroll-type apparatus which are cooled and which therefore may be made into efficient, large capacity compressors, expansion engines or pumps.

There is known in the art a class of devices generally referred to as "scroll" pumps, compressors and engines wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors and pumps are U.S. Pat. Nos. 1,376,291, 2,475,247, 2,494,100, 2,809,779, 2,841,089, 3,560,119, 3,600,114, 3,802,809 and 3,817,664 and British Patent 486,192.

Although the concept of a scroll-type apparatus has been known for some time and has been recognized as having some destinct advantages, the scroll-type apparatus of the prior art, as represented, for example, in the above-cited patents, has not been commercially successful, primarily because of sealing and wearing problems which have placed severe limitations on the efficiencies, operating life, and pressure ratios attainable. Such sealing and wearing problems are of both radial and tangential types. Thus effective axial contacting must by realized between the ends of the involute spiral elements and the end plate surfaces of the scroll members which they contact to seal against radial leakage and achieve effective radial sealing; and effective radial contacting with minimum wear must be attained along the moving line contacts made between the involute spiral elements to seal against tagential leakage.

Recently, however, the problems associated with sealing and wear have been minimized to the extent that scroll-type apparatus are able to compete in efficiency with other types of compressors, expansion engines and pumps. Solutions to these problems are embodied in the novel apparatus described in U.S. Pat. Nos. 3,874,827 and 3,884,599 and in U.S. Application Ser. Nos. 408,912, 561,478 and 561,479, all of which are assigned to the same assignee as this present invention. These solutions include providing means to counteract at least a portion of the centrifugal forces acting on the orbiting scroll member and to control tangential sealing forces along line contacts between the involute wraps of the scroll members; providing axial compliance/sealing means to insure efficient radial sealing between the involute wrap ends and the surfaces of the scroll member end plates; and providing novel means for developing axial forces to continually urge the scroll members into contact to maintain radial sealing.

As a result of the provision of these solutions to the basic scroll-type apparatus construction problems, there has now developed a demand for large-sized scroll-type apparatus, for example, for compressors having capacities in the order of 100 cubic feet/minute and larger. There is also a need for such apparatus capable of handling other fluids (e.g., helium) as well as air, and of operating, if desired, without the use of any lubricant in contact with these fluids.

These large-sized machines, however, present a problem in cooling, for the involute wraps constitute relatively large masses which can not be allowed to experience any temperature excursions which will effect any appreciable change in their geometries. Thus temperature control of the scroll members is necessary to controlling the component geometries. This in turn means that with temperature control the component parts can be machined to an initial accuracy which can be maintained throughout the operation of the apparatus.

It is therefore a primary object of this invention to provide scroll-type apparatus with highly effective cooling means. Another object is to provide scroll-type apparatus of the character described which may be constructed in relatively large sizes and which also may be formed to have self-lubricating surfaces for handling fluids which must remain free of any lubricant contaminants. It is still another object to provide scroll-type fluid compressors embodying effective cooling means which make it possible to control gas discharge temperatures to safe levels, to minimize work input to the fluid during compression, and to minimize the wear rate of self-lubricating bearing materials when the compressor is constructed to run dry without lubricants. It is yet another object to provide a cooled scroll-type apparatus having self-adjusting surfaces.

Other objects of the invention will in part be obvious and will in part be apparent hereinafter.

The invention accordingly comprises the features of construction, combinations of elements, and arrangement of parts which will be exemplified in the construction hereinafter set forth, and the scope of the invention will be indicated in the claims.

According to this invention, the involute wraps of both the stationary and orbiting scroll members have internal coolant circulation channel means and means are provided to circulate a fluid coolant through these internal channel means. In the case of the stationary scroll member, separate involutely configured channel means are also provided to circulate a cooling fluid within the stationary end plate. In the case of the orbiting scroll member, a similar involutely configured channel means is provided internally of the end plate of the orbiting scroll member. The internal fluid channels within the orbiting involute wrap and internal channel of the end plate of the orbiting scroll member are in fluid communication with one of the oil pockets of an oil-lubricated thrust bearing thus providing for the introduction of lubricating oil as a coolant for the orbiting scroll member. This lubricating oil coolant is discharged from the coolant channels of the orbiting scroll member through passage means which terminates within the apparatus housing such that the lubricating oil coolant may drain into a sump, be cooled and recirculated. Although the orbiting scroll coolant is lubricating oil, the coolant for the stationary scroll member may be any suitable fluid coolant including oil, water and the like.

Sealing means are provided to completely isolate the moving fluid pockets defined by the wraps between the end plates; this arrangement provides the opportunity, if desired, of using self-lubricating surfaces on the contacting involute wrap and end plate surfaces, which in turn means that the apparatus can run dry. Finally, the driving means of the apparatus used to illustrate the cooling means of this invention may incorporate means to force the contacting surfaces to "wear in" to make a good fit and achieve efficient sealing.

For a fuller understanding of the nature and objects of the invention, reference should be had to the following detailed description taken in connection with the accompanying drawings in which FIG. 1 is a longitudinal cross section of the forward end of a scroll-type, positive fluid displacement apparatus with cooling means constructed in accordance with invention;

The principles of the operation of scroll apparatus have been presented in previously issued patents. (See for example U.S. Pat. No. 3,884,599.) It is therefore unnecessary to repeat a detailed description of the operation of such apparatus. It is only necessary to point out that a scroll-type apparatus operates by moving a sealed pocket of fluid taken from one region into another region which may be at a different pressure. If the fluid is compressed while being moved from a lower to higher pressure region, the apparatus serves as a compressor; if the fluid is expanded while being moved from a higher to lower pressure region it serves as an expander; and if the fluid volume remains essentially constant independent of pressure then the apparatus serves as a pump.

The sealed pocket of fluid is bounded by two parallel planes defined by end plates, and by two cylindrical surfaces defined by the involute of a circle or other suitably curved configuration. The scroll members have parallel axes since in only this way can the continuous sealing contact between the plane surface of the scroll members be maintained. A sealed pocket moves between these parallel planes as the two lines of contact between the cylindrical surfaces move. The lines of contact move because one cylindrical element, e.g., a scroll member, moves over the other. This is accomplished, for example, by maintaining one scroll fixed and orbiting the other scroll. The cooling means of this invention will, for the sake of convenience, be assumed to be used in a positive fluid displacement compressor in which one scroll member is fixed while the other scroll member orbits in a circular path. However, it will be obvious that the invention is equally applicable to expansion engines and pumps.

Throughout the following description the term "scroll member" will be used to designate the component which is comprised of both the end plate and the elements which define the contacting surfaces making movable line contacts. The term "wrap" will be used to designate these elements making moving line contacts. These wraps have a configuration, e.g., an involute of a circle (involute spiral), arc of a circle, etc., and they have both height and thickness.

The scroll-type apparatus chosen to illustrate the cooling means of this invention is one which incorporates the driving means disclosed and claimed in U.S. Pat. No. 3,884,599 and U.S. Application Ser. No. 408,912, the axial compliance/sealing means of U.S. Application Ser. No. 561,479, and the scroll member construction disclosed in U.S. Application Ser. No. 570,170, assigned to the same assignee as the present invention.

Figure 1:
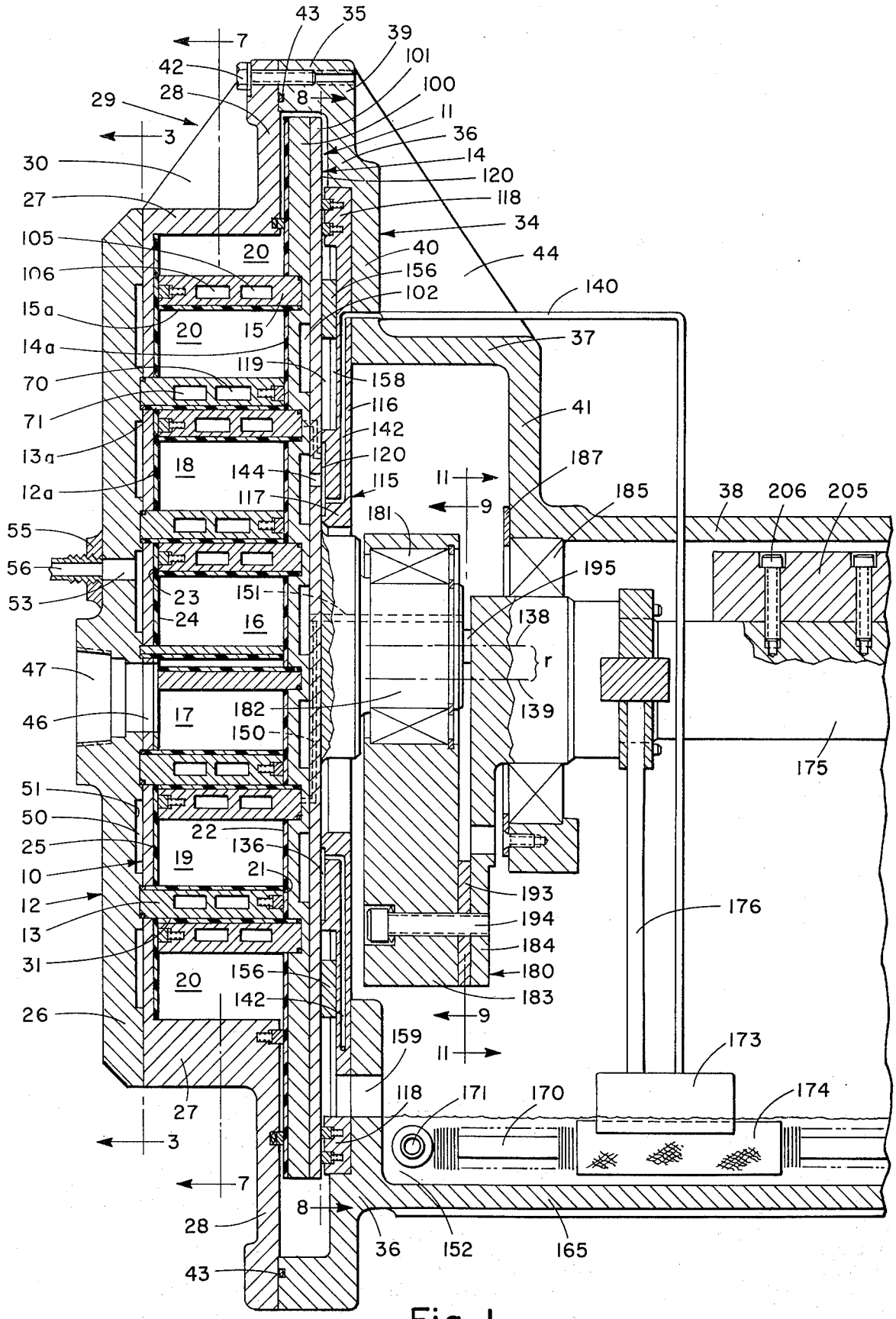

In FIG. 1, what may be termed the forward end of a compressor constructed in accordance with this invention is shown in detail. Although the apparatus illustrated and described will, for convenience, be referred to as a compressor, it should be understood that it may serve equally well as an expansion engine or a pump.

The apparatus of FIG. 1 has a stationary scroll member, generally indicated by the reference numeral 10, and an orbiting scroll member generally indicated by the reference numeral 11. Stationary scroll member 10 comprises an end plate, generally designated by the reference numeral 12, and an involute wrap 13 which in the embodiment illustrated in the drawings is formed separately and affixed to end plate 12. The contacting-/sealing surfaces of end plate 12 and of involute wrap 13 may optionally be formed to be self-lubricating. In the embodiment illustrated, these surfaces comprise separate layers of a self-lubricating material, e.g., a filled polytetrafluoroethylene, adhered to a metal end plate and involute wrap. Thus a layer **12*a* (FIGS. 4 and 5) of a self-lubricating material is shown for end plate 12 and a layer 13*a* of such material for the contacting surfaces of wrap 13**. Alternatively, if these contacting surfaces are to be self-lubricating, they may also be formed by treating the metal surfaces directly or by forming the contacting components entirely of a self-lubricating material.

In a similar manner, orbiting scroll member 11 comprises and end plate 14 with a self-lubricating layer 14*a* and an involute wrap 15, having a contacting surface 15*a* formed of self-lubricating material, affixed thereto.

As orbiting scroll member 11 is driven to orbit stationary scroll member 10 (by means described later) there are defined between the end plates and wraps a plurality of moving fluid pockets 16, 17, 18, 19 and 20, the fluid pressures in which increase from the periphery inwardly. In order to provide efficient scroll-type apparatus, it is necessary to achieve effective radial sealing between the contacting surface 21 (FIG. 4) of the involute wrap 13 of the stationary scroll member and surface 22 of end plate 14 of the orbiting scroll member and also between the contacting surface 23 of the involute wrap 15 of the orbiting scroll member and surface 24 of end plate 12 of the stationary scroll member. Effective continuous tangential sealing along the moving line contacts between the involute wraps, such as at line 31, is attained by a combination of proper machining, wearing in and the choice of driving mechanism as described below.

End plate 12 of the stationary scroll member is made up of forward housing end plate 25 and a facing plate 26. Integral with forward housing end plate 25 is forward scroll housing 27 which terminates in a flange 28. Housing end plate 25, facing plate 26, scroll housing 27 and flange 28 form the forward unit 29 of the compressor housing. A plurality of fins 30 are provided as heat transfer surfaces to cool this forward housing unit. A stepped-configured after housing unit 34, comprising sections 35, 36, 37 and 38 integrally connected through flange sections 39, 40 and 41, is affixed to forward housing unit 29 by means of a plurality of screws 42 and sealed through a elastomeric sealing ring 43. After housing section 34 has a plurality of external fins 44 also serving as surfaces for cooling this unit of the housing.

Fluid pocket 17, which is the zone of highest pressure, is in fluid communication through fluid port 46 and passage 47 in face plate 26 with a fluid conduit (not shown) through which compressed fluid is delivered from the compressor. Fluid to be compressed is taken into peripherial fluid pocket 20 through oppositely disposed inlets 48 and 49 (FIG. 7) which may, if desired, be connected to fluid conduits leading to a fluid source. If the apparatus is an expansion engine, then of course high-pressure fluid is delivered through port 46 and low-pressure fluid is discharged through ports 48 and 49. The above-described components are part of a basic scroll-type apparatus structure.

In order to provide internal cooling of the stationary end plate 12, it has an involutely-configured fluid coolant channel 50 which is conveniently formed by cutting an involute groove 51 (FIG. 3) in that face of facing plate 26 which contacts housing end plate 25 and then joining these components to define channel 50.

Figure 3:
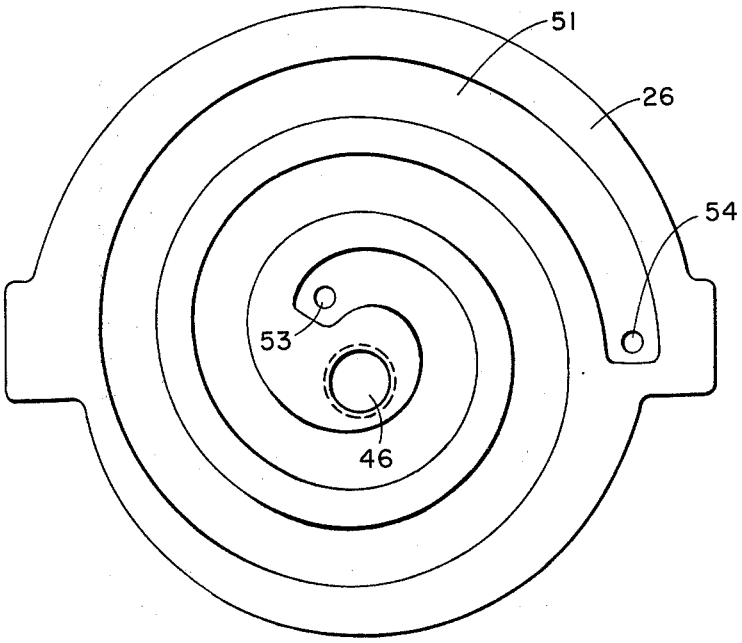
FIG. 3 is a section through plane 3—3 of FIG. 1 showing the involutely configured coolant channel for the end plate of the stationary scroll member.

Means are provided to introduce a suitable coolant, e.g., water or oil, into involute channel 50 which is provided with an inlet port 53 and a discharge port 54 (FIG. 3). These ports, as will be seen for port 53 in FIG. 1 typically comprise a passage drilled through facing plate 26, an internally threaded boss 55 affixed to facing plate and a threaded conduit 56, engageable with boss 55, to carry the coolant fluid from a source not shown. The discharge port 54 is similarly constructed.

Figure 4:
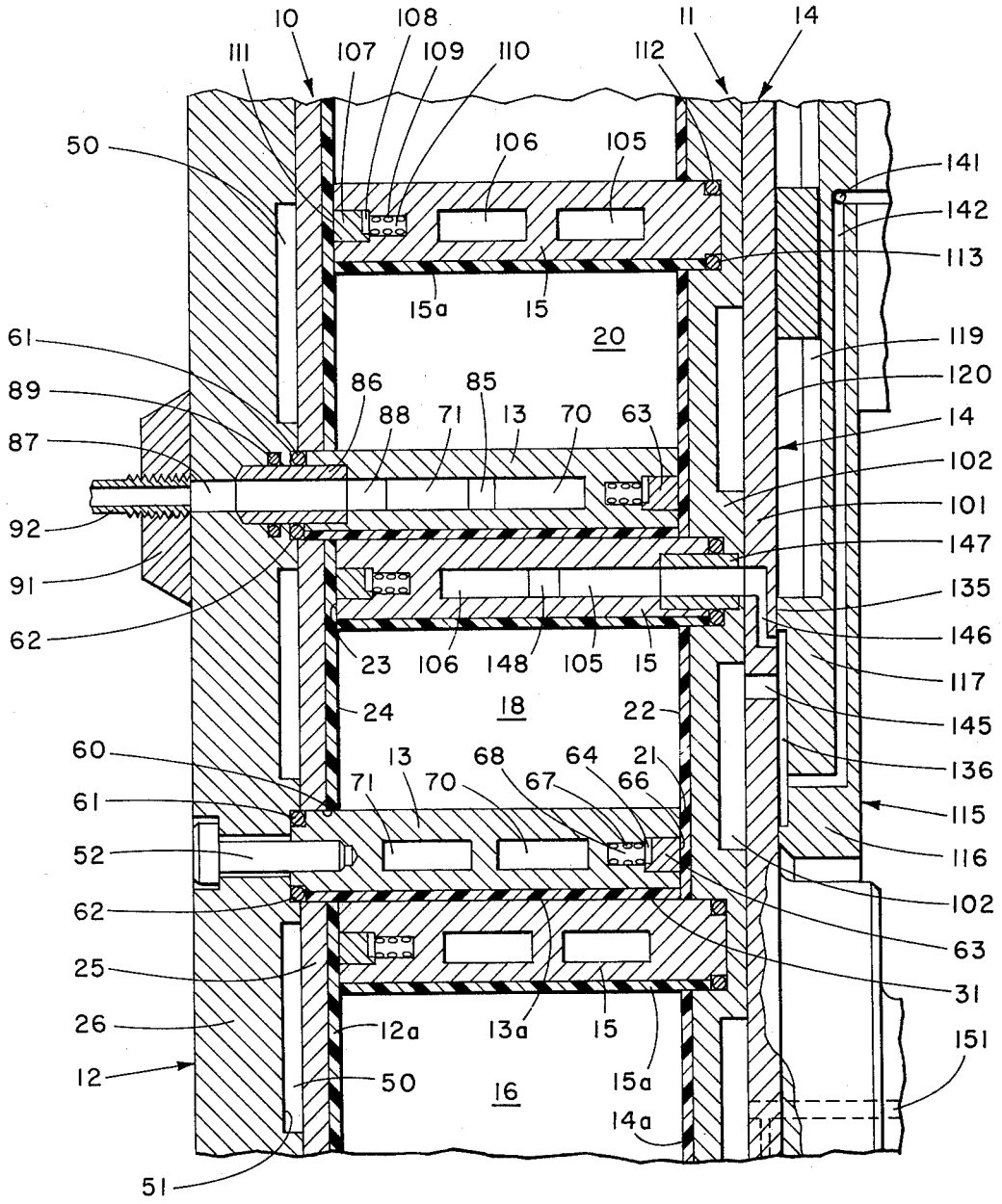
FIG. 4 is a detailed cross section of one portion of the apparatus showing the fluid inlet connection for the internal channels of the involute wrap of the stationary scroll member, the fluid coolant inlet and discharge passages associated with the orbiting scroll and the construction of the scroll members.

Before describing the means for internally cooling the wrap of the stationary scroll member, if will be helpful to described in more detail the construction of stationary scroll member 10, particularly with reference to FIG. 4 wherein like reference numerals are used to identify like components in FIG. 1. As previously pointed out, the scroll members are constructed to have axial sealing/compliance means in accordance with the teaching of U.S. Application Ser. No. 561,479 and to be formed as separate end plates and wraps as taught in U.S. Application Ser. No. 570,170. Therefore, stationary wrap 13 is mounted in stationary end plate 12 by cutting an involute slot through end plate 25 and a shallow involute groove corresponding to it in facing plate 26, the slot and groove forming together a sufficiently deep groove 60 to seat involute wrap 13 using parallel elastomeric sealing members 61 and 62. Screws 52 serve to affix wrap 13 to the end plate. Since the wrap in this case is rigidly mounted in the end plate, efficient radial sealing within the compressor is attained through the use of compliance/sealing means. The embodiment of the compliance/sealing means illustrated in FIG. 4 comprises an involute seal element 63, formed of a metal such as steel or bronze or a suitable plastic, and set in a groove 64 cut in the contacting surface of wrap 13. Seal element 63 is sized as to be able to experience small axial as well as radial excursions in groove 64 and contact between surface 66 of seal element 63 and contacting/sealing surface 22 of end plate 14 of orbiting scroll member 11 is maintained through an axial force exerted by spring 67 set in a groove 68 which is conveniently narrower than groove 64. Thus the seal element makes continuous contact and ensures that fluid does not leak from one fluid pocket to another. A number of different embodiments of the compliance/sealing means are described in detail in U.S. Application Ser. No. 561,479 and it is to be understood that any of these embodiments would be suitable in the apparatus of this invention.

Figure 6:
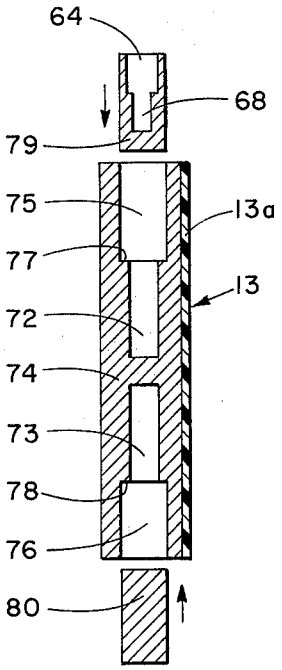
FIG. 6 is a cross section of an involute wrap illustrating one way of forming the internal coolant channels therein.
Figure 7:
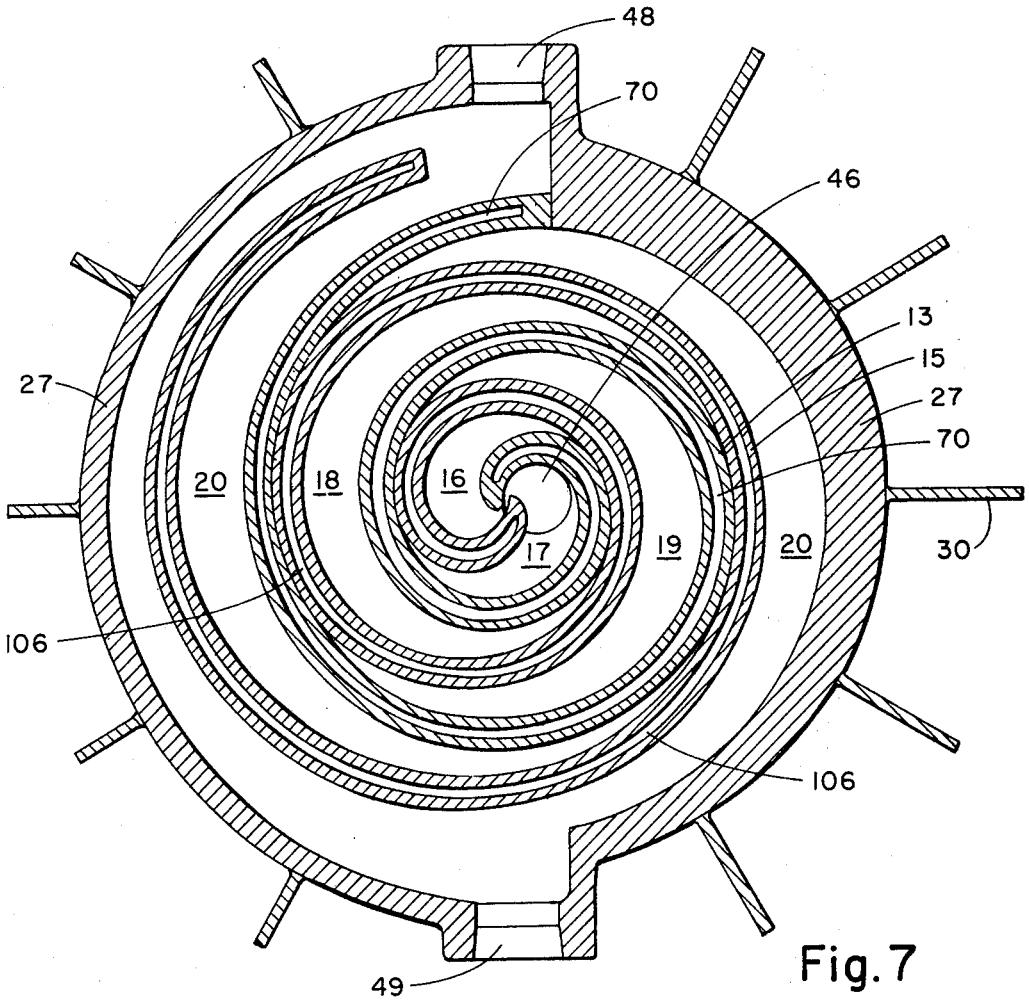
FIG. 7 is a cross section through the apparatus along plaen 7—7 of FIG. 1 showing the working fluid inlet and discharge ports and the internal channels of the wraps.
Figure 10:
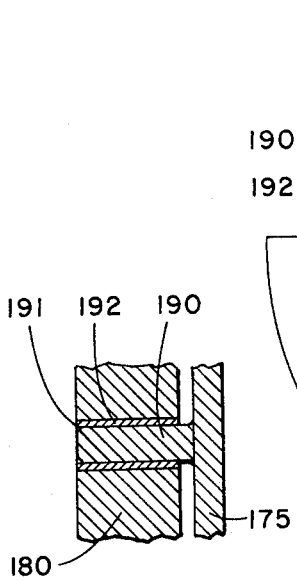
FIG. 10 is a cross section through plane 10—10 of FIG. 9 showing the pivot pin of the swing-link.
Figure 9:
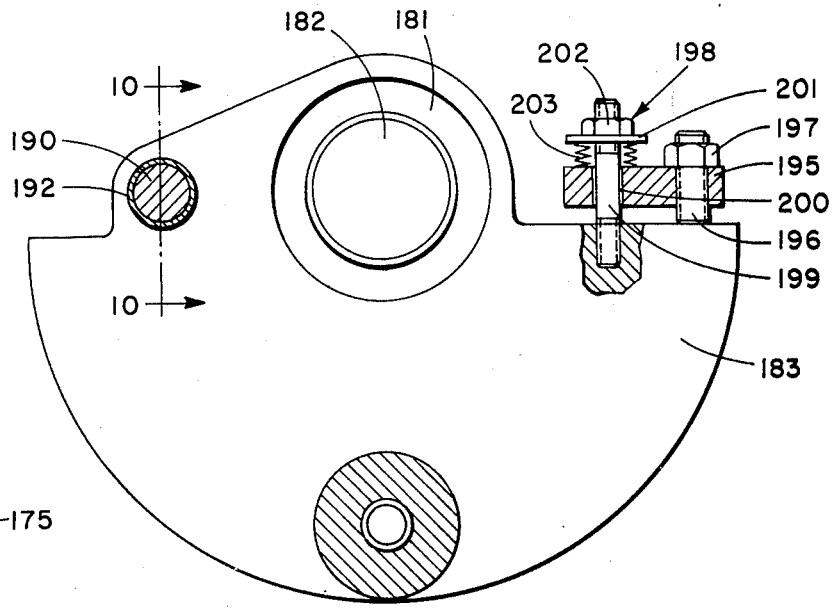
FIG. 9 is a cross section through plane 9—9 of FIG. 1 showing the swing-link driving mechanism for the orbiting scroll member.

Cooling of wrap 13 is achieved by circulating a fluid coolant through two parallel fluid channels 70 and 71 extending throughout essentially the entire length of the wrap (See FIG. 7). It is also within the scope of this invention to use one, as well as more than two, of such channels in the scroll member wraps. FIG. 6 illustrates one way by which wrap 13, having internal channels 70 and 71, may be made by first milling deep grooves 72 and 73 from each end of a wrap blank 74, the width of these grooves being the desired width of the final fluid channels 70 and 71. A second milling from both sides is then performed to cut grooves 75 and 76 of a width to provide shoulders 77 and 78 so positioned as to define the desired length of the fluid channels to be formed. Finally, a first insert 79, shaped to define grooves 64 and 68 and to fit into groove 75 is brazed, or otherwise fixed, into groove 75; and a second insert 80 shaped to fit into groove 76 is brazed therein. Insert 80 is made long enough to extend beyond groove 76 to define two sides of a channel adapted to contain sealing members 61 and 62 when the wrap is affixed to the end plate as shown in FIG. 4.

Figure 5:
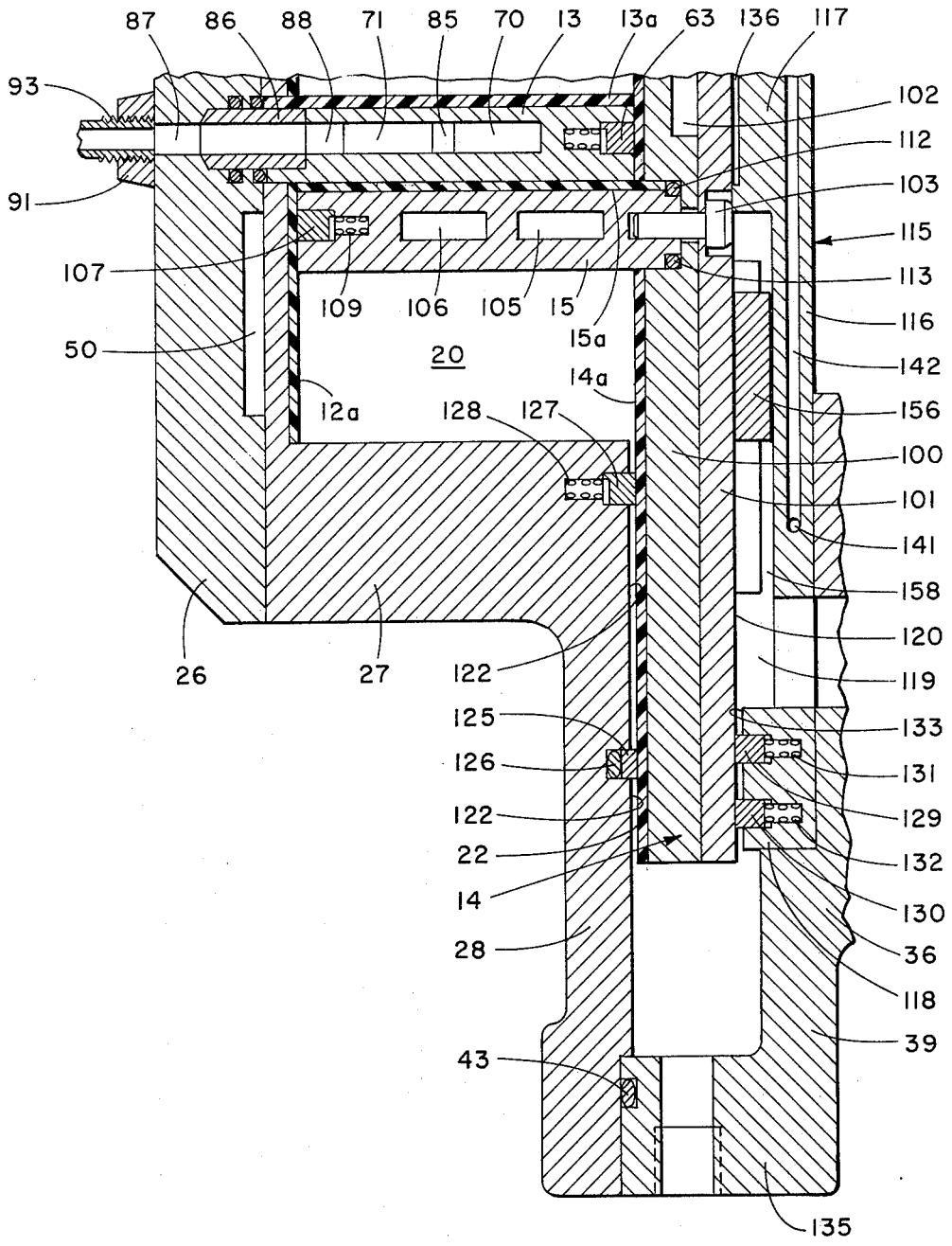
FIG. 5 is a detailed cross section of another portion of the apparatus showing the fluid outlet connection for the internal channels of the involute wrap of the stationary scroll member, and the sealing means for isolating the moving fluid pockets.

Cooling fluid is introduced and withdrawn from fluid channels 70 and 71 by the means shown in FIGS. 4 and 5. In the arrangement illustrated, the coolant is introduced on one side of the involute wrap and withdrawn on the other side. As is shown in FIG. 4, at that point in the wrap where the fluid is to be introduced, a connecting passage 85 is drilled to connect channels 70 and 71 and in place of the insert piece 80 (FIG. 6) there is placed a connector piece 86 extending into facing plate 26 to provide fluid communication between passage 87 drilled in plate 26 and passage 88 drilled in the wrap to communicate with channel 71. An additional sealing member 89 is provided to seal connector piece 86 in plate 26 and an internally threaded boss 91 is affixed to facing plate 26 for making an external connection between a fluid coolant inlet line 92 and the coolant channels to deliver coolant from an appropriate source (not shown). The fluid coolant discharge means in FIG. 5 is constructed in an identical manner for connection with a coolant discharge line 93.

The fluid used as the coolant for the stationary scroll member may be any desired heat transfer fluid such as water, oil and the like. Moreover, it may be the same or different for cooling the end plate and involute wrap for this scroll member since coolant channel 50 in the end plate is not connected with internal wrap channels 70 and 71.

The basic construction of orbiting scroll member 11 is similar to that of the stationary scroll member. Thus, as shown in FIGS. 1, 4 and 5, end plate 14 may be formed of two separate plates 100 and 101, plate 100 having a involute groove, similar to groove 51 (FIG. 3) of facing plate 26, which defines an involute fluid coolant channel 102 within end plate 14 when joined with plate 101 by suitable means such as brazing. Involute wrap 15 of the orbiting scroll member is formed in the same manner as the involute wrap of the stationary scroll member; and it has two parallel fluid coolant channels 105 and 106 (FIG. 4). It also has an involute seal element 107 in groove 108 actuated by a spring 109, located in groove 110, to ensure sealing contact between surface 111 of seal element 107 and surface 24 of the end plate of the stationary scroll member. The involute wrap 15 of the orbiting scroll member is affixed to end plate 14 by a plurality of screws 103 (FIG. 5) which also effect the rigid assemblly of plates 100 and 101 making up orbiting end plate 14. Sealing members 112 and 113 are provided for sealing the wrap to the end plate.

Inasmuch as the orbiting scroll member moves with respect to the housing and its framework during operation, it is necessary to provide means for introducing a fluid coolant into channels 102, 105 and 106 which are different from those means used for this purpose in conjunction with the stationary scroll member. In the embodiment illustrated in FIGS. 1, 4 and 8, these means for introducing the coolant are integrated into an oil-lubricated thrust bearing which is used to exert force on the orbiting scroll member to urge it into contact with the involute wrap of the stationary scroll member and to establish the effective sealing of the moving fluid pockets.

The oil-lubricated bearing, generally indicated by reference numeral 115, is in the form of an annular ring 116 having an inner depending ring 117 and an outer depending ring 118 defining between them an annular groove 119. Thrust bearing 115 is affixed to the compressor housing through flange section 40 and it is sized to abut the inside wall of section 36 of the housing. Inner ring 117 makes moving contact with surface 120 of end plate 14 of the orbiting scroll member while the opposite surface 22 of this end plate makes moving contact with the sealing surfaces of sealing elements 125 and 127 associated with housing sections 27 and 28 (See FIG. 5). In those cases where the compressor is to run dry, it is necessary to provide sealing to prevent any fluid from leaking out of pocket 20 as well as to prevent any lubricating oil used in the thrust bearing or as a coolant for the orbiting scroll member from entering any of the moving fluid pockets. Therefore, as shown in FIGS. 1 and 5, there are provided for this purpose an annular seal element 125 having an elastomeric ring 126 associated therewith, compliance/sealing means comprising seal element 127 and force-applying spring 128 and two concentric sealing elements 129 and 130 having a plurality of spaced springs 131 and 132 for their actuation. Thus no fluid can leak between any spacing which may be defined between surface 122 of housing section 28 and surface 22 of the end plate of the orbiting scroll member; and no oil can leak through any spacing which may be defined between surface 133 of ring 118 and surface 120 of end plate 14.

Figure 8:
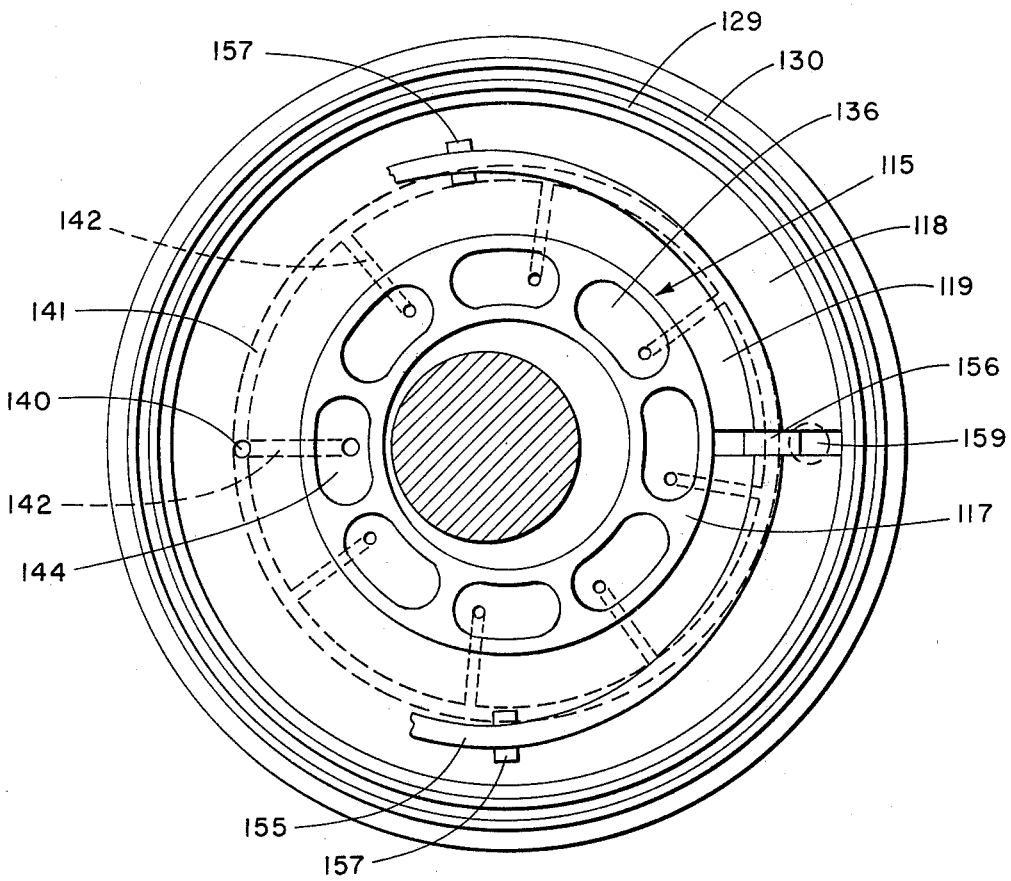
FIG. 8 is a cross section through plane 8—8 of FIG. 1 showing the contacting side of the oil-lubricated thrust bearing.
Figure 11:
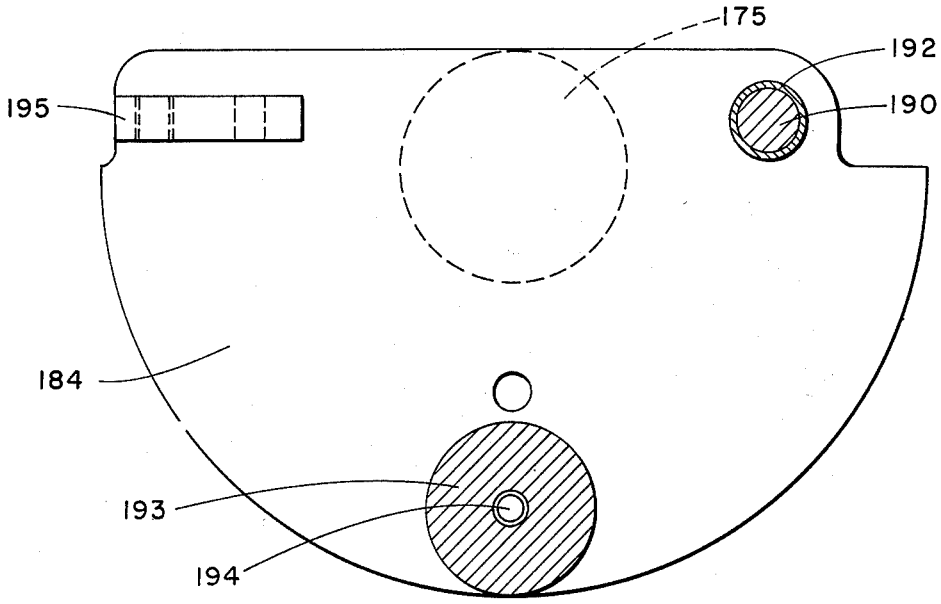
FIG. 11 is a cross section through plane 11—11 of FIG. 1 showing crankshaft counterweight means.

In contacting surface 135 of the inner dependent ring 117 of the thrust bearing there are defined a plurality of high-pressure oil pockets 136 (FIG. 8), the purpose of which is to generate an axial compressive reaction force on the orbiting scroll member and to supply a thin film of lubricant between surfaces 135 and 120 and to the coupling means described below. Since passage means must be provided to deliver oil, or other suitable lubricant, to these pockets, such passage means may also advantageously be used to deliver oil as a coolant to involute channel 102 in the orbiting scroll member end plate and to channels 105 and 106 in the orbiting involute wrap. These passage means comprises an oil delivery conduit 140 providing fluid communication between an oil sump (described below) and a circular manifold 141 in thrust bearing 116 (FIG. 8). Branch passages 142 lead from manifold 141 to fluid pockets 136, that branch passage leading to the one pocket 144 which supplies oil to the channels for cooling being sufficiently large to handle the high flow of oil required for cooling. This oil pocket 144, through which the oil coolant flows, is in turn in fluid communication through passage 145 with involute channel 102, and through passage 146 with connector piece 147 leading to channels 105 and 106 in wrap 15. Cooland is taken into channels 105 and 106 through connector piece 147 and passage 148 which connects channels 105 and 106, this being an arrangement similar to that described above for introducing coolant into the stationary involute wrap. Since passages 145 and 146 must be continuously open to pocket 144 it follows that the width of pocket 144 must be something greater than twice the orbit radius ,*r*, of the orbiting scroll member which is seen in FIG. 1 to be defined between the axes 138 and 139 of the orbiting scroll member drive and of the stationary scroll member, respectively.

The coolant is discharged from channels 105 and 106 through passage 150 which leads into passage 151 communicating with involute passage 102. Passage 151 leads through the driving mechanism to discharge oil into sump 152 in the housing.

Inasmuch as it is necessary to maintain a predetermined angular relationship between the stationary and orbiting scroll members during operation, coupling means must be provided to perform this function. In the scroll compressor embodiment illustrated, this coupling means takes the form of a ring 155 (FIG. 8) which has two pairs of oppositely disposed keys 156 and 157.

One pair of keys is affixed to one side of ring 155 and the other pair to the other side; and those on one side, e.g., keys 156, slidably engage slots 158 serving as a keyways in the thrust bearing and those on the other side, e.g., keys 157, slidably engage slots (not shown) in surface 120 of the orbiting end plate. Since both thrust bearing 116 and stationary scroll member 10 remain fixed, the coupling means, in effect, couples the two-scroll members. The lubricant reaching the coupling means is drained off through port 159 into oil sump 152.

Figure 2:
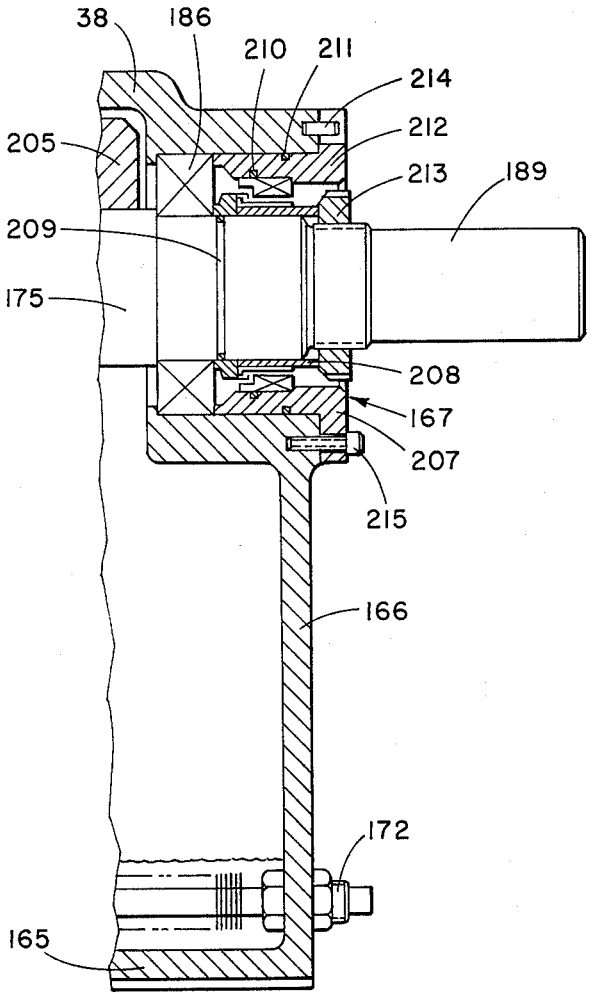
FIG. 2 is a longitudinal cross section of the after end of the apparatus of FIG. 1 illustrating the shaft bearings and the oil coolant discharge connection.

It will be apparent that in the construction illustrated, it is necessary to use the lubricant for cooling the orbiting scroll member since the coolant is introduced through the oil-lubricated thrust bearing. This arrangement, in turn, requires that means be provided to cool the oil prior to recycling it. The oil is collected in sump 152 defined within the compressor housing, the configuration of which is modified at the lower side to provide a semicylindrically-configured housing section 165 in place of the upper stepped configuration. As will be seen in FIG. 2, the housing terminates in a back plate 166 configured to seal a shaft bearing assembly 167.

A finned tubing 170 extends along the length of sump 152 and has an inlet port 171 and a discharge port 172 (FIG. 2) making it possible to circulate a coolant, e.g., water, for cooling the oil in the sump prior to recycling. An oil pump 173, having an oil pump screen 174, is positioned to pump oil from sump 152 into oil delivery line 140 leading to the thrust bearing and fluid coolant channels of the orbiting scroll member. Oil pump 173 is driven off crank shaft 175 through a connecting shaft 176.

As noted above, the driving mechanism for orbiting scroll member 11 which is used for illustrative purposes is one which incorporates means to overcome at least a fraction of the centrifugal force acting upon the orbiting scroll member as the orbiting scroll member is driven. This counter-balancing means is illustrated in FIGS. 1 and 9–11 as a swing-link 180 attached through roller bearing 181 to a scroll shaft 182 which is affixed to or is an extension of end plate 14 of orbiting scroll member 11. A counterweight 183 of swing-link 180 provides the means for overcoming a portion of the centrifugal force acting upon stationary scroll member 11 to lessen the wear on the rolling contacting involute wrap surfaces while achieving efficient tangential sealing.

The orbiting scroll member 11 is driven by a motor (not shown) as the driving means through crankshaft 175, to which a counterweight 184 is affixed. This counterweight provides both static and dynamic balancing of the inertial forces produced by the motion of the orbiting scroll and the swing-link. Crankshaft 175 is supported within the compressor housing by ball bearings 185 and 186 (FIG. 2), bearing 185 being held in place by a suitably affixed bearing retainer ring 187 and bearing 186 being located within the bearing/sealing assembly 167.

Connection between the crankshaft 175 and swing-link 180 is made through a pivot pin 190 which is affixed to crankshaft 175 (FIG. 10) and which engages a pin hole 191, lined with a self-lubricating material 192, in swing-link 180. In order to prevent vibration of the swing-link in the radial direction during operation, there is provided a swing-link damper 193 in the form of a disk of a self-lubricating material held by a screw 194 to make friction contact between the facing surfaces of the counterweight 183 and 184 which are part of the swing-link and crankshaft, respectively.

Finally, the drive mechanism has means to control and adjust the wear on those surfaces of the involute wraps of the scroll members which make moving line contacts. These means comprise an extension piece 195 (FIGS. 9 and 11) affixed to counterweight 184 of crankshaft 175 in which is mounted a hard stop 196 by means of a threaded nut 197. An adjustable spring device 198 is mounted in the edge of counterweight 183 and comprises a threaded screw 199 which passes through opening 200 in extension piece 195 and terminates in a washer 201 held by a nut 202 to bear on a spring 203 interposed between washer 201 and the surface of extension piece 195. In operation, the swing-link can move inwardly with its motion being damped by the swing-link can move inwardly with its motion being damped by the swing-link damper 193. However, its outward motion is finally restrained by its contact with hard stop 196. This is attained because contact between the involute wraps is brought about by the action of the force of spring 203 on extension piece 195 and as wear on the wrap surfaces takes place the swing-link goes outwardly until it contacts the hard stop. When this takes place there is no more preloading but only contact. Thus the involute wrap surfaces "wear in" which means that the compressor can operate over an extended period of time with effective tangential sealing without excessive wear.

A balancing counterweight 205 is affixed through screws 206 to crankshaft 175 to minimize vibration in the apparatus. The bearing assembly 167 (FIG. 2) is constructed in accordance with known practice and comprises mating rings 207 and 208, o-rings 209, 210 and 211, a seal adapter 212, a locknut 213, dowel pin 214 and a plurality of screws 215 to affix assembly 167 to drive shaft housing sections 38 and 166.

In the operation of a scroll compressor constructed in accordance with this invention (e.g., the apparatus of FIGS. 1 and 2) a coolant, e.g., water or oil, is circulated through involute channel 50 by introducing it through inlet port 53 and withdrawing it through discharge port 54 (FIG. 3) at a rate sufficient to maintain the temperature of the end plate of the stationary scroll member at a predetermined, desired level. Simultaneously, a coolant (normally but not necessarily the same as that circulated through involute channel 50) is circulated through internal channels 70 and 71 in the wrap of the stationary scroll member by introducing it through an inlet arrangement such as shown in FIG. 4 and withdrawing it through a discharge arrangement similar to the inlet arrangement. The rate at which the fluid coolant is circulated through the wrap is, likewise, that which will maintain the wrap at a predetermined temperature level. In both causes, i.e., cooling of the end plate and of the wrap, the predetermined temperature level is below that at which any appreciable geometry change is experienced by either the end plate or the involute wrap. In the case of the stationary scroll member, the fluid coolant, or coolants, is supplied from a source external of the apparatus.

In the case of the orbiting scroll member, however, the coolant, being provided by way of an oil-lubricated thrust bearing, must be the lubricant used. As pointed out above, this oil coolant is introduced into both the involute channel 102 in the orbiting end plate and into the parallel channels 105 and 106 in the orbiting wrap through one of the oil pockets of the oil thrust bearing. The oil lubricant is withdrawn from these channels by way of passages in the orbiting end plate and in central shaft 182 of the swing-link driving mechanism. The rate at which the oil coolant is circulated is likewise that required to maintain a predetermined temperature level which in turn is below that at which any appreciable geometric dimensional changes occur in the orbiting scroll member.

By providing means for the cooling of the mass of material forming the stationary and orbiting scroll members it is possible to provide stabilized geometry in scroll-type apparatus, thus in turn making it possible to construct such apparatus in far larger sizes than heretofore possible. Moreover, the attainment during operation of a stable geometry makes it possible to operate the apparatus to "wear in" contacting surfaces for optimum sealing and then to maintain these surfaces in precisely "worn in ." conditions to continue to insure good sealing over extended periods of operation. The contacting surfaces may be formed of a self-lubricating surface which permits handling fluids which must remain uncontaminated in the apparatus.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

I claim:

1. In a positive fluid displacement apparatus into which fluid is introduced through an inlet port for circulation therethrough and subsequently withdrawn through a discharge port, and comprising a stationary scroll member having an end plate and an involute wrap and an orbiting scroll member having an end plate and an involute wrap, driving means for orbiting said orbiting scroll member with respect to said stationary scroll member whereby said involute wraps make moving line contacts to seal off and define at least one moving pocket of variable volume and zones of different fluid pressure, coupling means to maintain said scroll members in fixed angular relationship, means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets, and tangential sealing means for effecting tangential sealing along said moving line contacts, the improvement comprising first internal coolant circulation channel means extending throughout essentially the entire length of said involute wrap of said stationary scroll member; means to circulate a fluid coolant through said first internal coolant circulation channel means; second internal coolant circulation channel means extending throughout essentially the entire length of said involute wrap of said orbiting scroll member; and means to circulate a fluid coolant through said second internal coolant circulation channel means during the orbiting of said orbiting scroll member.

2. A positive fluid displacement apparatus in accordance with claim 1 including oil-lubricated thrust bearing means engaging a surface of said end plate of said orbiting scroll and defining therewith a plurality of oil pockets, and means to supply oil to said oil pockets; and wherein said means to circulate said fluid coolant through said second internal coolant circulation channel means comprises fluid passage means extending between one of said oil pockets and said second internal coolant circulation channel means whereby said oil serves as said coolant for said orbiting scroll member.

3. A positive fluid displacement apparatus in accordance with claim 1 including first channel means defined within said end plate of said stationary scroll member and second channel means defined within said end plate of said orbiting scroll member and first and second means to circulate fluid coolant through said first and said second channel means, respectively.

4. A positive fluid displacement apparatus in accordance with claim 3 including oil-lubricated thrust bearing means engaging a surface of said end plate of said orbiting scroll and defining therewith a plurality of oil pockets, and means to supply oil to said oil pockets; and wherein said means to circulate said fluid coolant through said second internal coolant circulation channel means and said second means to circulate fluid coolant through said second channel means in said end plate of said orbiting scroll member comprise fluid passage means extending from one of said oil pockets to said second internal coolant circulation channel means and to said second channel means in said end plate of said orbiting scroll member, whereby said oil serves as said coolant for said orbiting scroll member.

5. A positive fluid displacement apparatus, comprising in combination a. a stationary scroll member having an end plate and an involute wrap;

b. an orbiting scroll member having an end plate and an involute wrap;

c. driving means, incorporating a main shaft and an orbiting scroll member shaft parallel therewith for orbiting said orbiting scroll member whereby said involute wraps make moving line contacts to seal off and define at least one moving pocket of variable volume and zones fo different fluid pressure, said driving means including radial compliant linking means between said main shaft and said orbiting scroll member shaft to attain tangential sealing along said moving line contacts;

d. coupling means to maintain said scroll members in fixed angular relationship;

e. means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets;

f. stationary scroll member cooling means comprising in combination 1. first stationary involutely configured channel means within said end plate of said stationary scroll member, 2. second stationary channel means extending internally throughout essentially the entire length of said involute wrap of said stationary scroll member, and 3. means to circulate a fluid coolant through said first and second stationary channel means;

g. orbiting scroll member cooling means comprising in combination 1. first orbiting involutely configured channel means within said end plate of said orbiting scroll member,
2. second orbiting channel means extending internally throughout essentially the entire length of said involute wrap of said orbiting scroll member, and
3. means to circulate a fluid coolant through said first and second orbiting channel means; and h. housing means.

6. A positive fluid displacement apparatus in accordance with claim 5 wherein said end plates of said stationary and said orbiting scroll members are each formed as two engageable plate members, one of which has an involute groove; whereby when they are held in engagement they define said first stationary and said first orbiting channel means.

7. A positive fluid displacement apparatus in accordance with claim 5 wherein said second stationary and said second orbiting channel means comprise at least two parallel channels extending throughout essentially the entire lengths of said wraps.

8. A positive fluid displacement apparatus in accordance with claim 5 wherein said means to circulate a fluid coolant through said first and second stationary channel means comprise first fluid conduit means in fluid communication with said first channel means for introducing fluid thereinto and withdrawing therefrom and second fluid conduit means in fluid communication with said second channel means for introducing fluid thereinto and withdrawing fluid therefrom.

9. A positive fluid displacement apparatus in accordance with claim 5 wherein said end plates of said stationary and said orbiting scroll members have involute grooves corresponding in configuration to said involute wraps of said stationary and said orbiting scroll members and said involute wraps are positioned in said involute grooves and sealed therein to form said scroll members.

10. A positive fluid displacement apparatus in accordance with claim 5 including compliance/sealing means associated with each of said involute wraps, each compliance/sealing means comprising in combination a seal element of the same involute configuration as its associated wrap through which said axial contact is effected, and force applying means for actuating said seal element to effect said radial sealing.

11. A positive fluid displacement apparatus in accordance with claim 5 including sealing means within said housing for isolating said at least one moving pocket from the remaining volume defined within said housing.

12. A positive fluid displacement apparatus in accordance with claim 5 wherein the surfaces of said involute wraps and of said end plates which make sealing contacts are formed of a self-lubricating surface.

13. A positive fluid displacement apparatus in accordance with claim 12 wherein said self-lubricating surface comprises a separate layer of a self-lubricating material adhered to said involute wraps and to said end plates.

14. A positive fluid displacement apparatus in accordance with claim 5 wherein said means for providing said axial force comprises oil-lubricated thrust bearing means engaging a surface of said end plate of said orbiting scroll and defining therewith a plurality of oil pockets, and means to supply oil to said oil pockets; and wherein said means to circulate a fluid coolant through said first and second orbiting channel means comprise inlet fluid passage means extending from one of said oil pockets to said first and said second orbiting channel means and discharge fluid passage means extending through said end plate of said orbiting scroll member from said first and said second orbiting channel means to an oil sump within said housing means.

15. A positive fluid displacement apparatus in accordance with claim 14 wherein said means to supply oil to said oil pockets comprises conduit means connecting said oil pockets with said oil sump and pump means to force oil through said conduit means.

16. A positive fluid displacement apparatus in accordance with claim 14 including heat exchange means within said pump to circulate an externally supplied coolant in indirect heat exchange with oil in said oil sump.

17. A positive fluid displacement apparatus in accordance with claim 14 wherein the width of said one of said pockets

18. A positive fluid displacement apparatus in accordance with claim 5 wherein said radial compliant linking means includes means to provide a centripetal radial force adapted to oppose at least a fraction of the centrifugal force acting upon said orbiting scroll member.

19. A positive fluid displacement apparatus in accordance with claim 18 wherein said radial compliant linking means is a swing-link and said means to provide said centripetal radial force comprises counterweight means attached to said swing-link and further wherein said driving means includes counterweight means attached to said main shaft.

20. A positive fluid displacement apparatus in accordance with claim 19 including damper means for making friction contact between facing surfaces of said counterweight means attached to said swing-link and said counterweight means attached to said main shaft.

21. A positive fluid displacement apparatus in accordance with claim 20 including wear control means to control and adjust the wear on the surfaces of said involute wraps of said stationary and said orbiting scroll members, said wear control means comprising in combination an extension piece having an opening therethrough affixed to said counterweight means attached to said drive shaft, a hard stop affixed to said extension piece and engageable with the edge surface of said counterweight means attached to said swing link, screw means extending through said opening in said extension piece and being affixed to said counterweight means attached to said swing-link, and adjustable spring means affixed to said screw means bearing on said extension piece.

* * * * *

UNITED STATES PATENT OFFICE

CERTIFICATE OF CORRECTION

Patent No. 3,986,799 Dated October 19, 1976

Inventor(s) John E. McCullough

It is certified that error appears in the above-identified patent and that said Letters Patent are hereby corrected as shown below:

Col. 13, claim 8, line 28, after "withdrawing" insert --fluid--.

Col. 14, claim 17, line 27, after "pockets" insert --is at least equal to twice the orbit radius of said orbiting scroll member whereby there exists continuous fluid communication between said one of said pockets and said first and second orbiting channel means through said fluid passage means.--

Signed and Sealed this

Nineteenth Day of April 1977

[SEAL]

*Attest:*

RUTH C. MASON
*Attesting Officer*

C. MARSHALL DANN
*Commissioner of Patents and Trademarks*